US008607370B2

(12) United States Patent
Hoang et al.

(10) Patent No.: US 8,607,370 B2
(45) Date of Patent: Dec. 17, 2013

(54) FLUSH VALVE AND VACUUM GENERATOR FOR VACUUM WASTE SYSTEM

(75) Inventors: Thao Hoang, Rockford, IL (US); Mark A. Pondelick, Rockford, IL (US); Christopher Hardwick, Roscoe, IL (US); Robin Whitt, Big Bear Lake, CA (US); Greg King, Roscoe, IL (US)

(73) Assignee: B/E Aerospace, Inc., Wellington, FL (US)

( * ) Notice: Subject to any disclaimer, the term of this patent is extended or adjusted under 35 U.S.C. 154(b) by 933 days.

(21) Appl. No.: 12/571,545

(22) Filed: Oct. 1, 2009

(65) Prior Publication Data

US 2010/0083435 A1 Apr. 8, 2010

Related U.S. Application Data

(60) Provisional application No. 61/102,674, filed on Oct. 3, 2008.

(51) Int. Cl.

| | |
|---|---|
| ***E03D 11/02*** | (2006.01) |
| ***E03D 11/00*** | (2006.01) |
| ***E03D 11/10*** | (2006.01) |
| ***F16K 1/16*** | (2006.01) |

(52) U.S. Cl.
USPC ..... 4/430; 4/431; 4/434; 251/302; 251/301

(58) Field of Classification Search
USPC ..... 4/430, 431, 432, 434, 435, 422; 251/302
See application file for complete search history.

(56) References Cited

U.S. PATENT DOCUMENTS

| | | | | |
|---|---|---|---|---|
| 2,878,829 | A | | 3/1959 | Folmsbee |
| 3,835,479 | A | * | 9/1974 | Milette et al. ..... 4/435 |
| 4,635,901 | A | * | 1/1987 | Pond ..... 251/355 |
| 4,693,447 | A | | 9/1987 | Perez |
| 4,713,847 | A | | 12/1987 | Oldfelt et al. |
| 5,048,130 | A | * | 9/1991 | Brotman et al. ..... 4/483 |
| 5,099,867 | A | * | 3/1992 | Emery ..... 137/1 |
| 5,142,712 | A | | 9/1992 | Hennessy |
| 5,317,763 | A | | 6/1994 | Frank et al. |
| 5,326,069 | A | | 7/1994 | Clear et al. |
| 5,344,085 | A | | 9/1994 | Hofseth |

(Continued)

FOREIGN PATENT DOCUMENTS

JP 63-121548 A 5/1988

OTHER PUBLICATIONS

Office Action issued in related application JP2011-530210, dated Dec. 27, 2012, 3 pages.

(Continued)

*Primary Examiner* — Gregory Huson
*Assistant Examiner* — Christine Skubinna
(74) *Attorney, Agent, or Firm* — Drinker Biddle & Reath LLP

(57) ABSTRACT

The apparatus and method of the invention provides for a flush valve for controlling the vacuum evacuation of waste from a receptacle. The flush valve comprises an inlet port for receiving the waste from the receptacle, an outlet port opposite the inlet port and in fluid communication therewith, a source of vacuum connected to the outlet port and a uniquely designed discharge disk disposed between the inlet and outlet ports for interrupting the flow of fluid therebetween. In the preferred embodiment the flush valve is integral with a latticed panel of the waste receptacle stand.

20 Claims, 6 Drawing Sheets

(56) References Cited

U.S. PATENT DOCUMENTS

| | | | | |
|---|---|---|---|---|
| 5,372,710 | A | 12/1994 | Frank | |
| 5,515,554 | A | 5/1996 | Clear et al. | |
| 5,535,770 | A | 7/1996 | Nurmi | |
| 5,707,027 | A | 1/1998 | Hiesener | |
| 5,754,987 | A | 5/1998 | Johansson et al. | |
| 5,813,061 | A | 9/1998 | Tornqist | |
| 5,873,135 | A | 2/1999 | Tornqvist | |
| 5,899,438 | A * | 5/1999 | Gunder | 251/229 |
| 6,131,596 | A | 10/2000 | Monson | |
| 6,148,860 | A | 11/2000 | Sigler | |
| 6,152,160 | A | 11/2000 | Bowden Wilcox et al. | |
| 6,325,356 | B1 * | 12/2001 | Rozenblatt | 251/302 |
| 6,349,425 | B1 | 2/2002 | Stradinger et al. | |
| 6,353,942 | B1 | 3/2002 | Pondelick et al. | |
| 6,370,709 | B1 | 4/2002 | Stradinger et al. | |
| 6,453,481 | B1 | 9/2002 | Pondelick et al. | |
| 6,513,174 | B1 | 2/2003 | Johansson | |
| 6,536,055 | B2 | 3/2003 | Pondelick et al. | |
| 6,648,002 | B2 | 11/2003 | Lappalainen | |
| 6,704,947 | B2 * | 3/2004 | Stradinger et al. | 4/431 |
| 6,981,285 | B2 | 1/2006 | Sigler et al. | |
| 2007/0226887 | A1 | 10/2007 | Lappalainen et al. | |
| 2007/0297894 | A1 * | 12/2007 | Dandasi et al. | 415/55.1 |
| 2009/0159827 | A1 * | 6/2009 | Ellis et al. | 251/163 |

OTHER PUBLICATIONS

Office Action issued in related application CA2737002, dated Feb. 12, 2013, 3 pages.

* cited by examiner

FLUSH VALVE AND VACUUM GENERATOR FOR VACUUM WASTE SYSTEM

CROSS-REFERENCE TO RELATED PATENT APPLICATIONS

This patent application claims the benefit of U.S. Provisional Patent Application No. 61/102,674, filed Oct. 3, 2008.

FIELD OF THE INVENTION

This invention generally pertains to vacuum waste systems and, more particularly, to flush valves for vacuum waste receptacles such as vacuum toilets.

BACKGROUND

Vacuum waste systems are generally known in the art for use in transportation vehicles such as aircraft. Vacuum waste systems typically comprise a toilet bowl connected by vacuum piping to a waste tank. A flush valve is disposed between the toilet and the vacuum piping. When the flush valve opens, the contents of the toilet bowl are removed by differential pressure to the waste tank because the air pressure in the line under vacuum is lower than ambient air pressure in a toilet bowl. The flush valve maintains the pressure boundary between ambient air in the toilet bowl and the lower pressure of the piping and the waste tank. In an aircraft, the piping may be placed under vacuum pressure at altitudes under about 16,000 feet by a vacuum source. At altitudes about 16,000 feet and above, the vacuum pressure in the piping may be supplied by the atmospheric pressure differential between the cabin and the exterior of the airplane.

Conventional flush valves and methods for controlling the removal of waste from the toilet bowl to a waste tank are generally known. Such prior flush valves may use a large, rotating disk having an aperture to admit waste past the aperture. The use of such a large disk is undesirable because it makes the overall flush valve large, heavy and unwieldy for use in confined places such as aircraft lavatories.

Furthermore, the use of a disk having an aperture requires precise positioning of the aperture over the waste inlet so that waste moving from the toilet bowl to the piping leading to the waste tank does not catch or accumulate on the perimeter of the aperture or on the solid portion of the disk causing the disk to stick or not seal properly. Also, over time and due to normal wear, the accuracy of the positioning of such disk apertures tend to slip, aggravating the aforementioned problems.

Another problem with conventional flush valves using a disk with an aperture to admit waste past the disk is that users are not able to open them manually. This can result in unsanitary back-up of waste in the toilet bowl and overflow of waste from the toilet bowl into the lavatory area if the flush valve becomes stuck in the closed position.

A need exists for a smaller, easily installed and more efficient flush valve, which does not rely on a disk having an aperture, for controlling the removal of waste from toilet bowls in a vacuum toilet systems.

SUMMARY

This invention is generally directed to providing improved power usage, efficiency and reliability in evacuation of waste from a toilet bowl in a vacuum waste system and for providing a more streamlined and compact flush valve design that takes up less space than prior flush valves used in the confined area of aircraft lavatory compartments. The apparatus and method of the invention achieve this by way of a flush valve utilizing a uniquely shaped discharge disk. Such discharge disk does not include an aperture and is just large enough to seal the flush valve outlet. The discharge disk is smaller and lighter than any discharge disk used in prior flush valves. Because the disk is smaller and uniquely shaped, the operation of the disk requires little space and has a relatively small current draw as compared to conventional flush valves. Furthermore, in a preferred embodiment the flush valve is an integral component of a unique lightweight latticed toilet stand. This unconventional integrated design further minimizes the weight and space requirements for the valve. These are important advantages because minimization of weight, space and power usage are top design considerations in the aircraft industry.

Additionally, the present valve includes a manual override function for increased reliability. In yet another aspect, the vacuum source used is a centrifugal, single impeller, vacuum generator powered by a brushless DC motor. Because this vacuum generator design generates less heat than prior vacuum generator designs, the impeller and housings of the generator can be made of engineered polymer thereby drastically reducing the generator weight over conventional vacuum generator assemblies used with aircraft flush valves. Also, the smaller and lighter impeller is mounted directly on the motor shaft thereby decreasing the moment of inertia and allowing the vacuum generator to reach and maintain target vacuum pressure while using less power than conventional vacuum generators. These and other advantages of the invention will be apparent from the description of the invention provided herein.

BRIEF DESCRIPTION OF THE DRAWINGS

The above-noted and other advantages of the invention will be apparent from the description of the invention provided herein with reference to the attached drawings in which.

DETAILED DESCRIPTION OF THE EMBODIMENTS

The embodiment of the invention described below is not intended to be exhaustive or to limit the invention to the precise structure and operation disclosed. Rather, the embodiment described in detail below has been chosen and described to explain the principles of the invention and its application, operation and use in order to best enable others skilled in the art to follow its teachings.

This invention is generally directed to a flush valve and method for controlling the evacuation of waste from a toilet in a vacuum waste system, including particularly an aircraft vacuum waste system. The following examples further illustrate the invention but, should not be construed as in any way limiting its scope.

Figure 10:
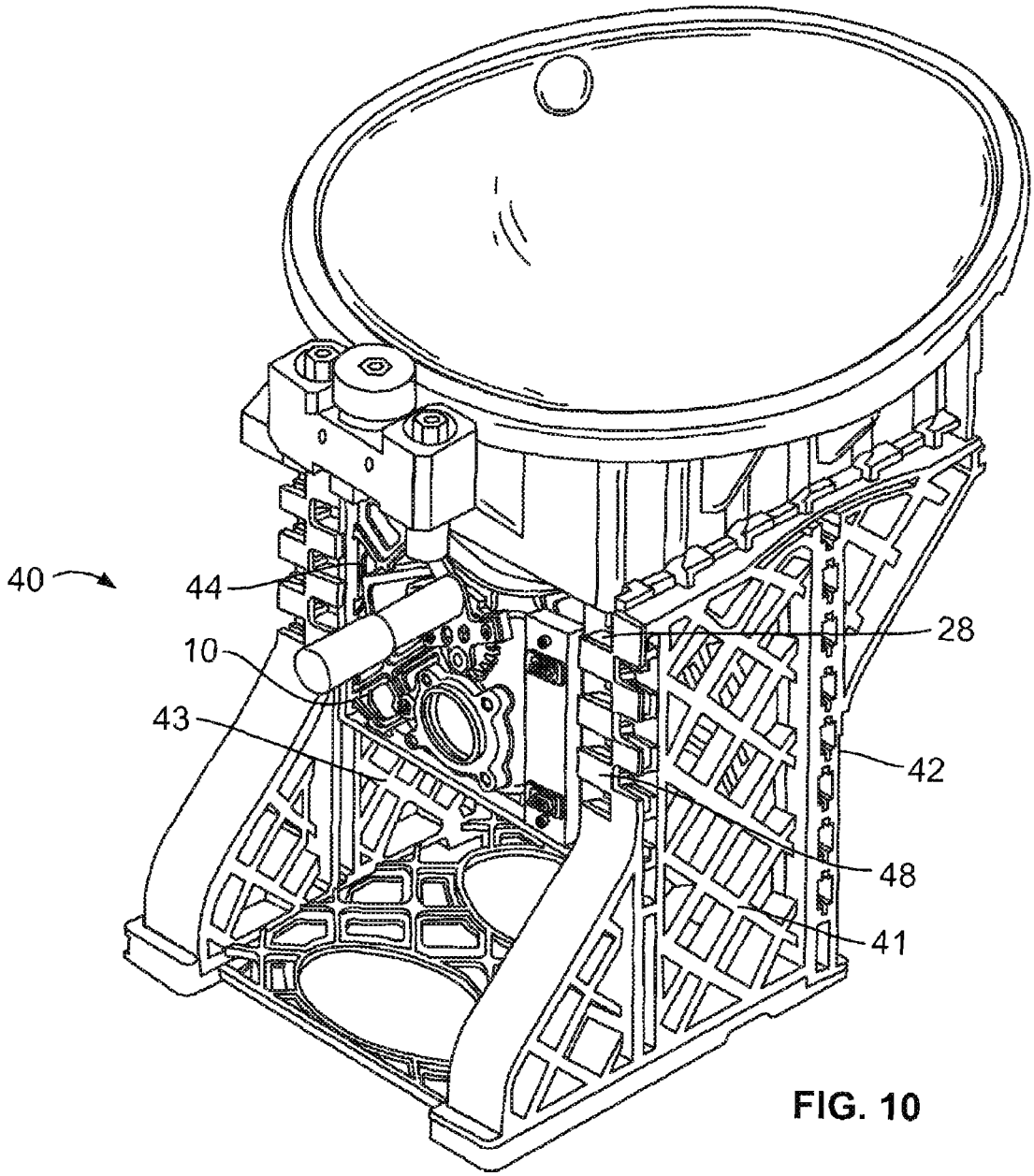
FIG. 10 is a perspective view of the toilet stand showing the side panel incorporating the flush valve.

Turning now to FIGS. 1-4, an embodiment of the flush valve of the present invention for controlling the evacuation of waste from a toilet in a vacuum waste system is labeled 10. In this embodiment of the invention, flush valve 10 is designed as an integral component of a toilet supporting stand 40 (FIG. 10) for a vacuum toilet waste receptacle 47. The toilet supporting stand 40 has four interlocking sides, 41, 42, 43 and 44 each of which has an open lattice structure, as shown, to minimize weight and maximize structural strength. Stand 40 is described in detail in a U.S. patent application entitled "Vacuum Waste System and Method for Using the Same," Ser. No. 61/102,812, filed Oct. 3, 2008. The disclosure of this contemporaneously filed application relating to the structure of the stand is incorporated by reference.

Figure 1:
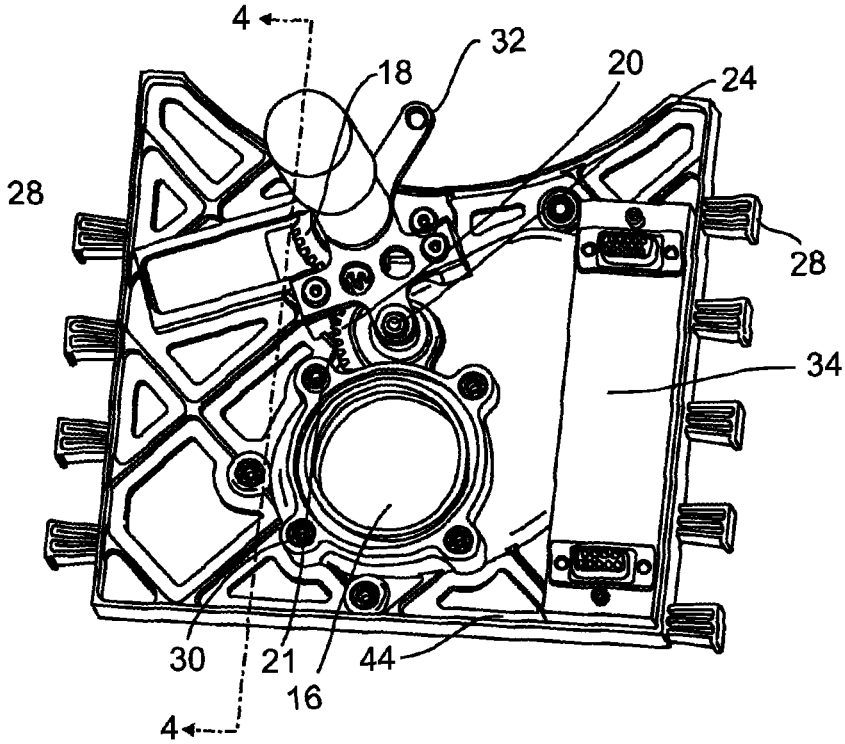
FIG. 1 is a perspective view of the outside of the back of one side of a latticed toilet stand showing key components of the flush valve of the present invention as an integral part of the toilet stand side.
Figure 2:
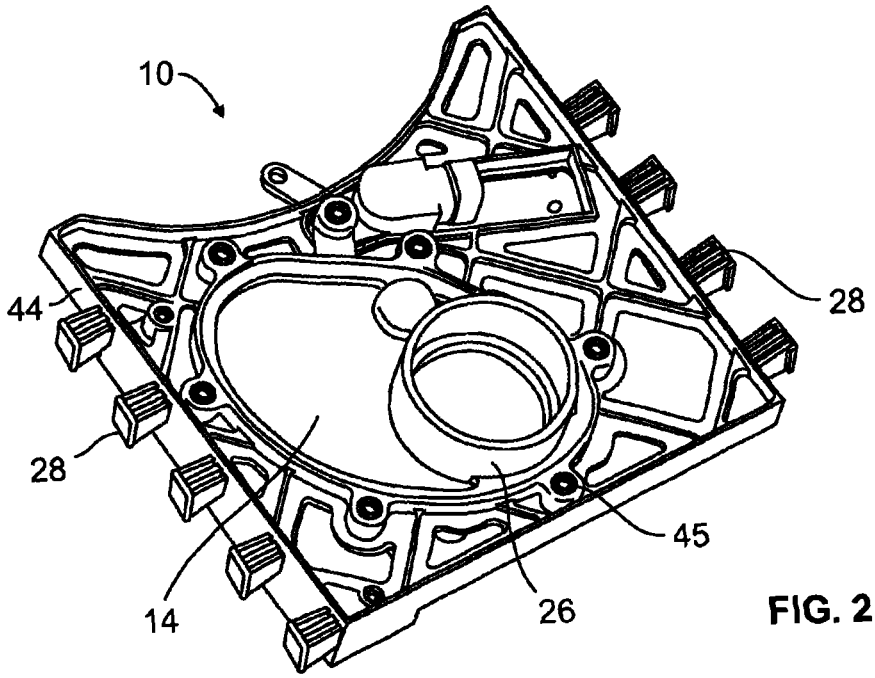
FIG. 2 is a perspective view of the front of the toilet stand side depicted in FIG. 1 in which a cover is applied to enclose the flush valve components.
Figure 3:
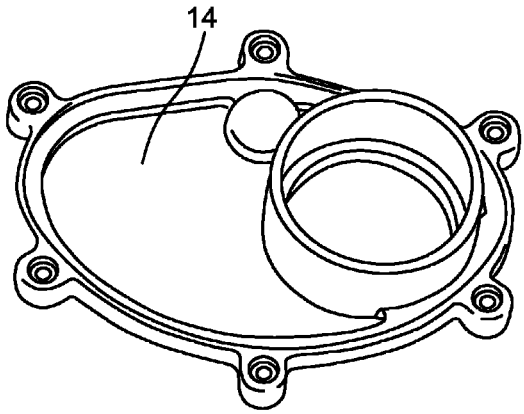
FIG. 3 is a perspective view of the cover of the flush valve in accord with an embodiment of the present invention.

Sides 42 and 44 have a series of interlocking dovetails 28 (FIGS. 1-2 and 10) on their edges for attachment to the dovetail receivers 48 (FIG. 10) of adjacent panels 41 and 43 of the stand. In other embodiments, Sides 42 and 44 may have a series of dovetail receivers on their edges for attachment to dovetails of adjacent panels 41 and 43 of the stand. Stand side 44 shown in FIGS. 1-2 depicts the flush valve 10 of the invention as a component of side 44 of the stand. The key components of the valve comprise a discharge disk 16, a driver gear 18, a follower gear 20, an actuator shaft 22 (FIG. 4), a follower shaft 24, and a sensor 25 (FIG. 4), all of which are mounted to stand side 44 as shown. A front valve cover 14 is attached to the stand panel 44 by threaded fasteners 45 or other appropriate means in order to at least partially enclose the discharge disk 16 which is located in a cavity between side panel 44 and the cover 14. Gasketing (not shown) is interposed between side panel 44 and cover 14 to create a seal to prevent leakage from the cavity.

Figure 4:
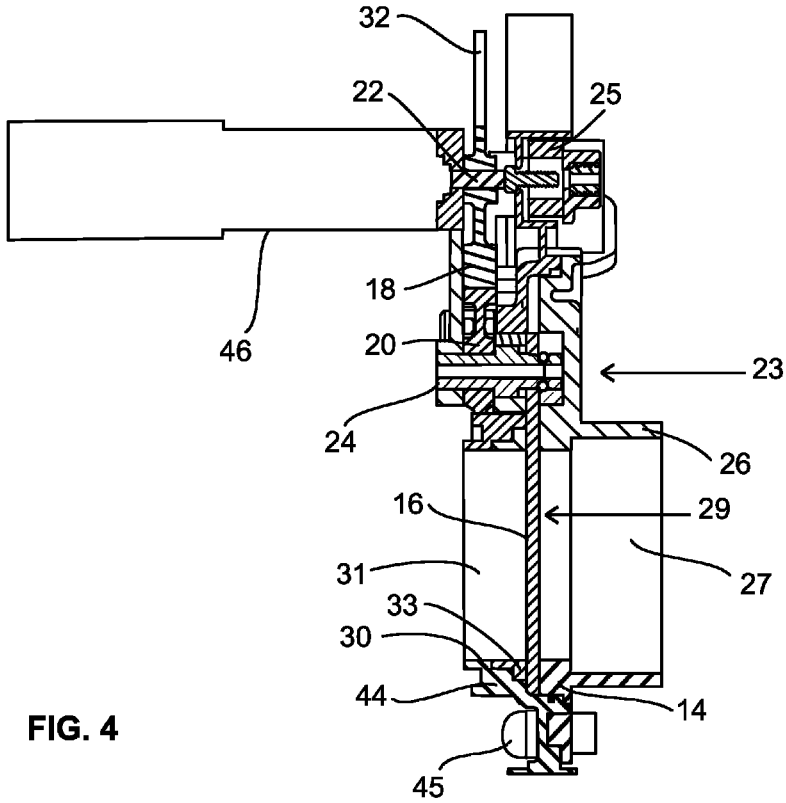
FIG. 4 is a cross-section view of FIG. 1, taken along lines 4-4 of FIG. 1.

Stand side 44 includes an integral annular flange 30 positioned above the discharge disk with an outlet port 31 (as best seen in FIG. 4) aligned with a corresponding inlet port 27 in the front valve cover 14. The cover 14 includes an annular flange 26 that has an inlet port 27 which receives waste from the toilet bowl (not shown). The outlet port 31 is attached to piping (not shown) and is in fluid communication with the inlet port 27 and a waste tank (not shown) when the discharge disk 16 is open (as discussed subsequently).

An appropriate conventional flush valve actuator 46 (as shown diagrammatically in FIG. 4) has an integral actuator shaft 22. In a preferred embodiment the flush valve actuator is a 28 VDC motor. The actuator shaft 22 is attached to and rotates driver gear 18 when the flush valve actuator is operated. The driver gear has an integral extension arm 32 for manually opening and closing the flush valve. As best seen in FIGS. 1 and 4, a follower gear 20 meshes with the driver gear 18 and turns a follower shaft 24 attached to a discharge disk 16 (FIG. 4).

Discharge disk 16 is disposed between the inlet port 27 and the outlet port 31. The discharge disk 16 includes a rotary section 23 and a covering section 29. The rotary section 23 of the discharge disk 16 is the portion of the discharge disk 16 that is attached to the follower shaft 24. The covering section 29 is the portion of the discharge disk 16 that is of a size and shape corresponding to the size and shape of the outlet port 31. The covering section 29 is continuous insofar as it does not include any apertures or holes. The rotary section 23 is mounted on the side panel 44 by the follower shaft 24. The rotary section 23 rotates back and forth between a closed position (FIG. 1) and an open position in which the covering section 29 of the discharge disk 16 is substantially clear of the outlet port 31 such that substantially the entire boundary between the inlet and outlet ports is open. In a preferred embodiment, the disk rotates in a plane, substantially 90 degrees between the closed position and the open position in about 0.7 seconds. In the open position, inlet port 27 and outlet port 31 of the flush valve are in fluid communication with each other. When in the closed position, as shown in FIG. 1, the covering section 29 of disk 16 interrupts the fluid communication (or pressure boundary) between the inlet port 27 and the outlet port 31 and seals the outlet port 31 from receiving waste from the toilet bowl. A sleeve seal 33, preferably made of polyethylene, is disposed adjacent to the perimeter of the outlet port 31 within the annular flange 30 of the outlet port 31. The face of the seal is in contact with the covering section 29 and preferably has a 32 micro finish or better. When the disk 16 is in the closed position, vacuum present in the outlet port 31 and the sleeve seal 33 achieve a seal that prevents waste leakage. The covering section 29 is dimensioned to be slightly larger than seal 33 to insure complete closure.

Figure 5:
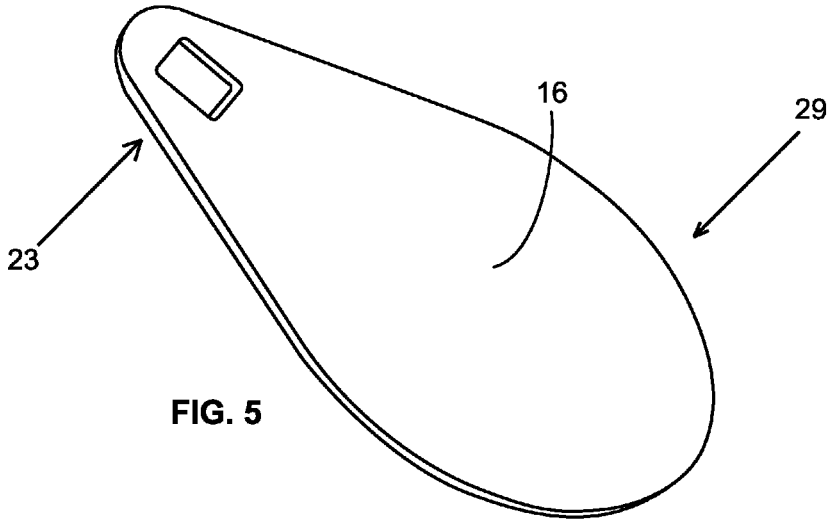
FIG. 5 is a perspective view of the discharge disk in the flush valve in accordance with an embodiment of the present invention.
Figure 6:
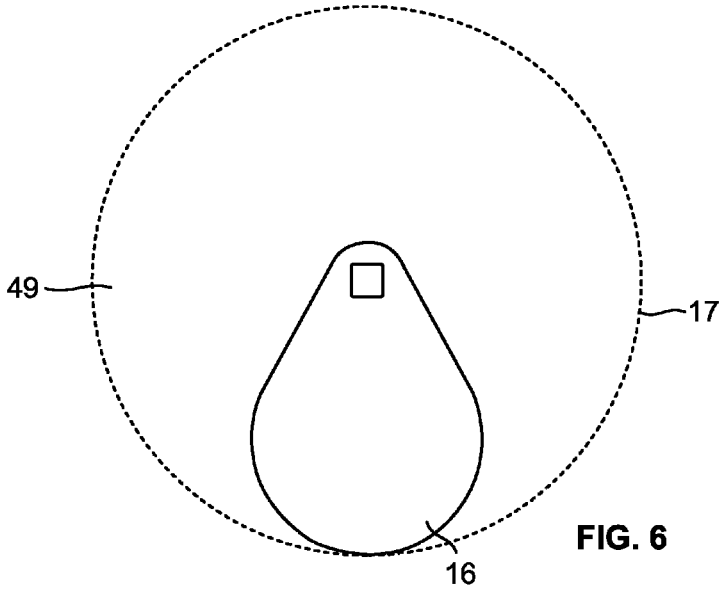
FIG. 6 is a perspective view of the disk of FIG. 5 as compared to the size and shape of flush valve disks of the prior art.

In a preferred embodiment, discharge disk 16 is tear-shaped as shown in FIG. 5. In a tear-shaped discharge disk 16, the rotary section 23 is the narrower trailing portion of the discharge disk 16 and the covering section 29 is the wider leading portion of the discharge disk 16. As illustrated in FIG. 6, the depicted tear-shape is significantly smaller and therefore more lightweight than discharge disks 17 typically used in conventional flush valves since the non-functional material in area 49 is absent from disk 16. The shape of the discharge disk 16 is not limited to a tear-shape. As long as the covering section 29 seals the outlet port 31 from receiving waste from the toilet bowl, other appropriate shapes, including but not limited to, round, triangular or polygon shapes, may be used with different portions of non-functional material removed. "Non-functional material" means material in the rotary section that is not necessary to maintain the integrity of that section and in the covering section that is not necessary to cover the boundary between the inlet 27 and outlet port 31. In discharge disks having shapes without a narrower trailing portion, the rotary section 23 is that portion of the discharge disk 16 that attaches to the follower shaft 24 and the covering section 29 is that portion of the discharge disk 16 that is of a size and shape corresponding to the size and shape of the outlet port 31. In some embodiments, the discharge disk 16 may be a combination of shapes. The rotary section 23 may be a different shape than the covering section 29. For example, the discharge disk 16 may be the shape of a paddle with an elongated rotary section 23 resembling a handle and a wider, rounded covering section 29 resembling the shape of the face of a ping pong paddle.

As best seen in FIG. 4, the actuator shaft 22 is attached to and rotates a sensor 25 such as a potentiometer. An integrated system controller (ISC) 34 (FIG. 1) attached to the side panel 44, is electrically connected to the sensor 25 and receives data from the sensor related to the angular position of the actuator shaft 22. Because the actuator shaft 22 also rotates a driver gear 18, which in turn causes rotation of the follower gear 20 and disk 16, the ISC indirectly reads the position of disk 16.

Any appropriate vacuum generator may be used to provide a pressure differential in the piping attached to the flush valve outlet port 31 by drawing air out of the waste tank connected to the piping when the valve is open. However a preferred vacuum generator is a single stage centrifugal vacuum generator with a brushless DC motor. This vacuum generator is preferred because it is smaller, lighter weight and uses less power than other types of vacuum generators yet is capable of rapidly achieving target vacuum. This vacuum generator has a single impeller and preferably is powered by a high-speed brushless DC motor.

Figure 7:
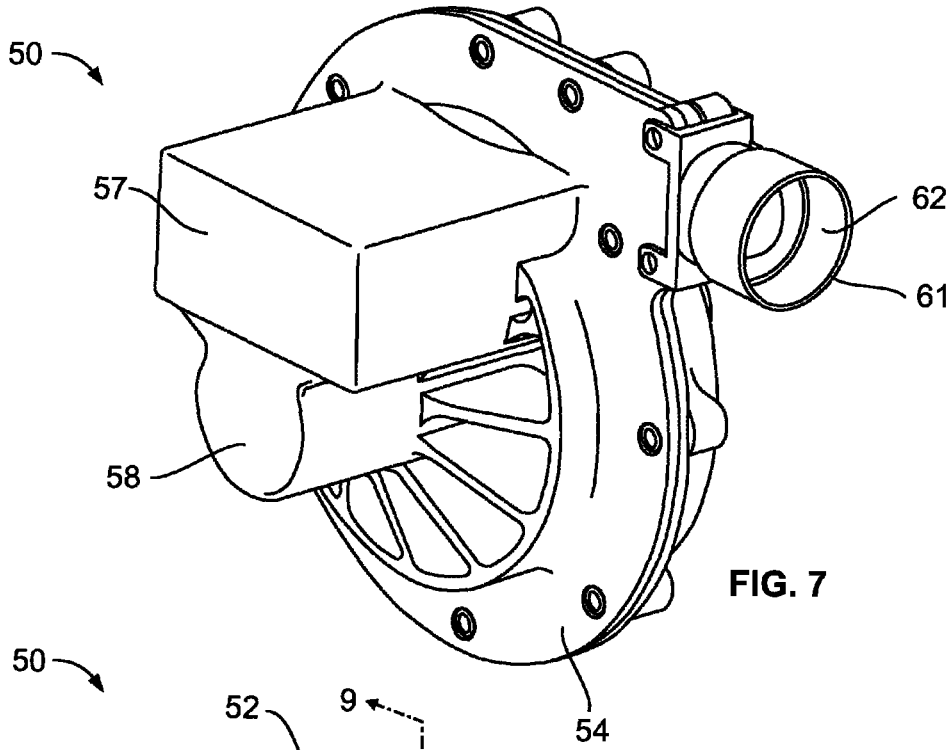
FIG. 7 is a perspective view of the vacuum generator in accordance with the present invention.
Figure 8:
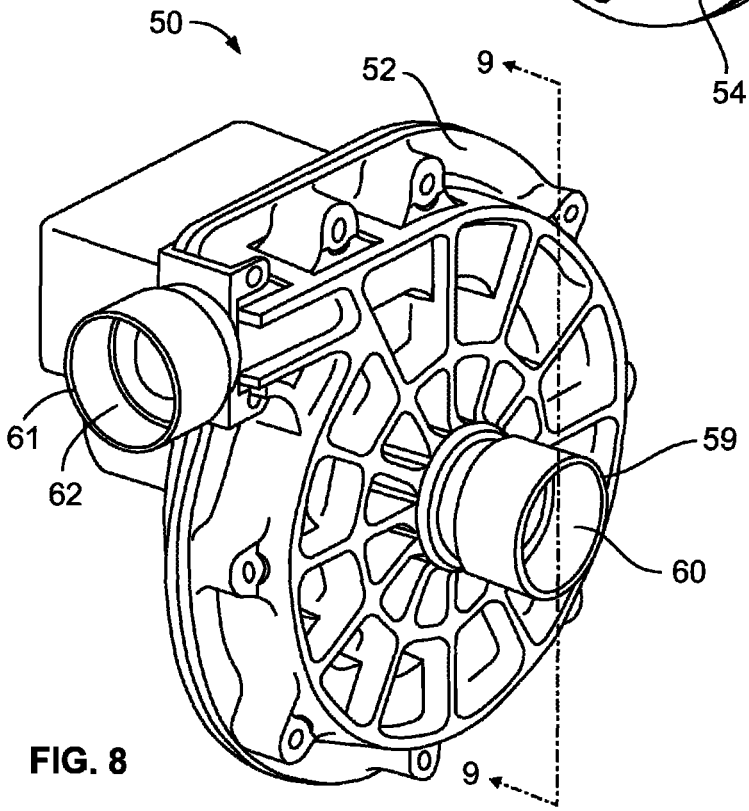
FIG. 8 is a perspective view of the vacuum generator in accordance with the present invention.
Figure 9:
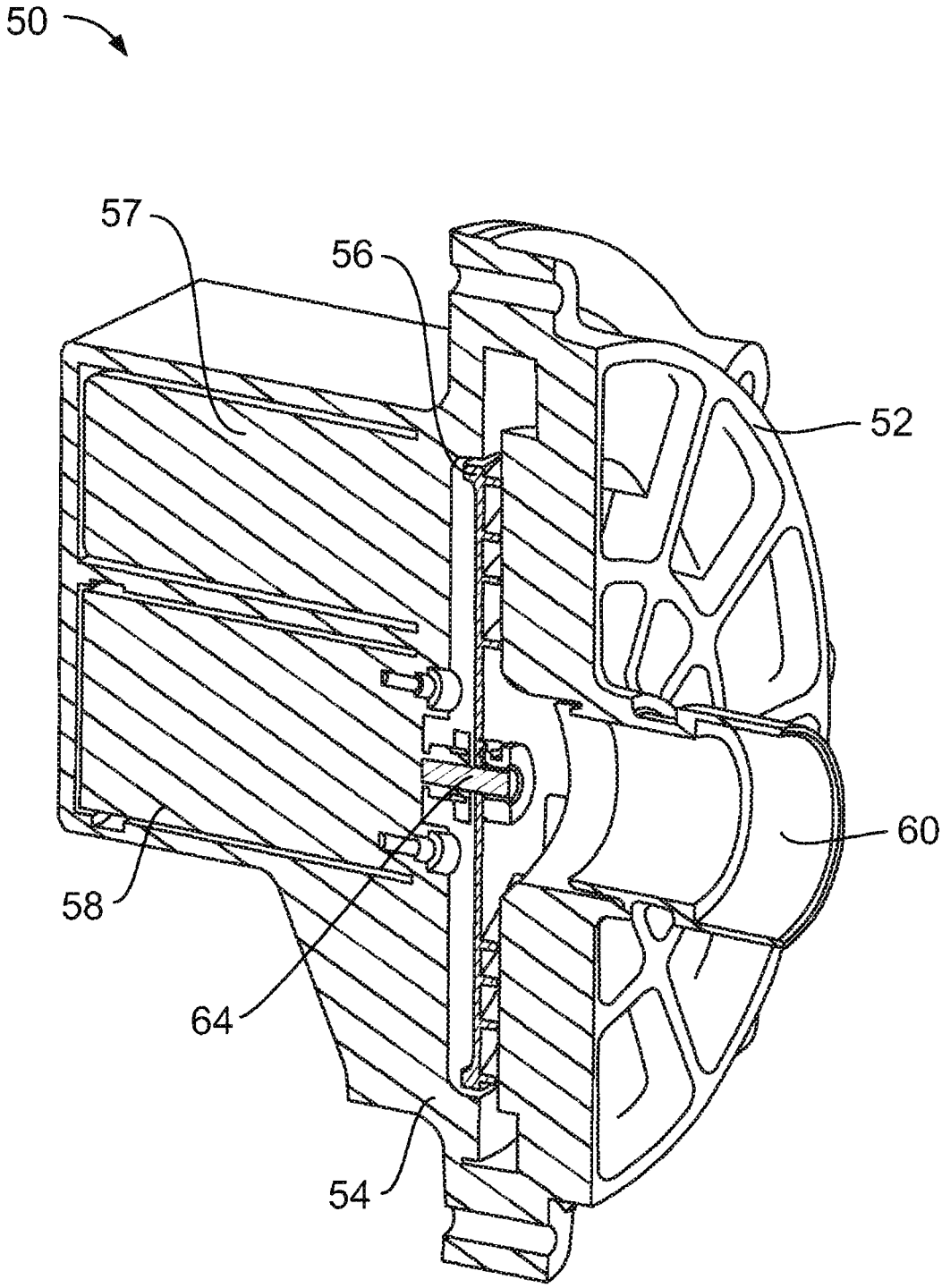
FIG. 9 is a cross sectional view of the vacuum generator of FIG. 8 taken along lines 9-9.

A preferred centrifugal vacuum generator 50 shown in FIGS. 7-9 comprises a scroll top housing 52, a scroll bottom housing 54, a single impeller 56 (FIG. 9), a vacuum generator controller (VGC) 57, a DC brushless motor 58, an intake flange 59 and an exhaust flange 61. Thus, air is drawn from the waste tank into the vacuum generator through the intake aperture 60 formed by the intake flange 59 of the scroll top housing 52. The impeller 56 spins the air outward into a scroll chamber that routes the air to an exhaust aperture 62 formed by the exhaust flange 61. The housings 52, 54 and the impeller 56 preferably are constructed from engineered polymer to reduce their weight, to keep the design compact and to resist icing during operation in cold weather. The impeller is mounted on a motor shaft 64 (FIG. 9) which is connected to the DC motor 58 and rotates within the housings 52, 54 at about 40,000-90,000 rpm, preferably 40,000-50,000 rpm. Because the impeller 56 is small and light weight, it can be mounted directly on the motor shaft 64 of the DC motor 58 which results in a decreased moment of inertia that allows the vacuum generator assembly to reach target speeds quickly. Furthermore, the resulting decreased moment of inertia over conventional vacuum generators used in similar applications, enables the use of a smaller DC motor and decreases the current draw. The VGC 57 controls the motor 58, receives inputs from the level sensors (not shown) on a waste tank (not shown), and optionally controls system heaters (not shown).

When a user actuates a switch to flush the toilet, the switch triggers an electrical signal to the integrated system controller 34 which activates the flush valve actuator 46. In response, the flush valve actuator causes rotation of the actuator shaft 22 and the attached driver gear 18 having drive gear teeth 19 (FIGS. 1 and 4). In the preferred embodiment, the actuator shaft and driver gear are rotated substantially 90 degrees in a clockwise direction. The meshing of the drive gear teeth 19 with teeth 21 of the follower gear 20 rotates follower shaft 24 and discharge disk 16 attached to the follower shaft, substantially 90 degrees counterclockwise to the open position. In the open position, the discharge disk clears the perimeter of both inlet port 27 and outlet port 31 such that inlet port 27 is in fluid communication with the outlet port 31. The directions of rotation may be clockwise, rather than counterclockwise if desired. Similarly, the range of rotation may also vary as desired. In other embodiments it may be desirable to provide a greater degree of rotation of the discharge disk to be sure that the disk completely clears the inlet port.

When the discharge disk is in the open position, the difference in pressure between the ambient air present in the toilet bowl and the lower air pressure in the piping between the toilet bowl (not shown) and the waste tank produces a suction force to evacuate the waste from the toilet bowl to the waste tank through the piping. The lower air pressure in the piping is generated by a vacuum generator (preferably generator 50 described above) at altitudes under about 16,000 feet and by atmospheric pressure outside of the plane at altitudes of about 16,000 feet and above.

After about one second following the opening of the flush valve, the system controller 34 signals the flush valve actuator to rotate the actuator shaft 22 and driver gear 18 substantially 90 degrees counterclockwise. This rotates follower shaft 24 and discharge disk 16 substantially 90 degrees clockwise so that the fluid connection between the inlet port 27 and the outlet port 31 is closed by the disk 16 and seal 33 is sealed from receiving more waste from the toilet bowl.

In case of a power failure to the flush valve actuator, the flush valve can be operated manually. To operate the flush valve manually, extension arm 32 will be rotated by the user substantially 90 degrees to open the flush valve and then back substantially 90 degrees in the opposite direction to close the flush valve. Thus, in the event that the flush valve sticks or becomes stuck in the closed position, the extension arm 32 may be rotated by the user to open the flush valve. This novel feature prevents the unsanitary back-up of waste in the toilet bowl and the potential overflow of waste from the toilet bowl into the lavatory area because the flush valve is closed.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A vacuum toilet system that includes a waste receptacle stand comprising:

a panel that serves as a side of the stand, removably mounted in the stand;

a valve housing formed in the panel having a single outlet for connection to the vacuum source and a single inlet aligned with the outlet and in selectable fluid communication with the outlet;

a discharge disk mounted in the valve housing including a rotary section and a covering section, the disk being aperture-free except at the rotary section, the covering section being of a size and shape corresponding to the size and shape of the single outlet, the rotary section being mounted to the housing for rotary movement between a closed position in which the covering section seals the outlet from fluid communication with the inlet and an open position in which the covering section is clear of the outlet;

a sleeve seal disposed in the valve housing between the outlet and the discharge disk, the sleeve seal abutting a perimeter of the outlet to seal the outlet when the discharge disk is in the closed position; and gearing mounted on the panel for rotating the discharge disk in response to a driving force applied to the gearing.

2. The vacuum toilet system of claim 1 wherein the vacuum source is a vacuum generator in fluid communication with the outlet.

3. The vacuum toilet system of claim 2, wherein the vacuum generator is a single stage centrifugal vacuum generator having an impeller mounted directly on a motor shaft.

4. The vacuum toilet system of claim 1, wherein the discharge disk is of a shape selected from the group consisting of tear, round and paddle.

5. The vacuum toilet system of claim 1, wherein the discharge disk is tear-shaped, the rotary section is at the narrower trailing portion of the tear-shape, and the covering section is at the wider leading portion of the tear-shape.

6. The vacuum toilet system of claim 1, further comprising:

a drive assembly for rotating the discharge disk; and a motor operatively connected to the drive assembly.

7. The vacuum toilet system of claim 6, further comprising an extension arm connected to the drive assembly to manually rotate the drive assembly to move the discharge disk between the opened and closed positions.

8. The vacuum toilet system of claim 1, wherein the range of rotary movement of the discharge disk is about 90 degrees.

9. The vacuum toilet system of claim 1, further comprising a sensor adapted to determine the position of the discharge disk.

10. The vacuum toilet system of claim 9, wherein the sensor is a potentiometer attached to an actuator shaft for rotating the discharge disk to determine the rotational position of the actuator shaft.

11. A vacuum toilet system that includes a vacuum toilet waste receptacle supported by a waste receptacle stand comprising:

a waste receptacle stand;

a panel that serves as a side of the stand, removably mounted in the stand;

a valve housing formed in the panel having a single outlet for connection to the vacuum source and an inlet aligned with the outlet in selectable fluid communication with the outlet;

a discharge disk mounted in the valve housing including a rotary section and an outlet covering section, the covering section spaced apart from the rotary section, the disk being aperture-free except at the rotary section, the covering section being of a size and shape corresponding to a size and shape of the single outlet, the rotary section being mounted to the housing for rotary movement about the rotary section between a closed position in which the covering section seals the outlet from fluid communication with the inlet and an open position in which the discharge disk is clear of the outlet;

an actuator shaft mounted on the housing;

a follower gear mounted on the housing and adapted to rotate the discharge disk;

a driver gear mounted on the actuator shaft and adapted to rotate the follower gear; and an extension arm integral with the driver gear for manually opening the flush valve.

12. A vacuum toilet system having an integral flush valve, the system comprising:

a vacuum toilet waste receptacle supported by a waste receptacle stand;

the stand having an integral flush valve panel, the panel serving as a side of the stand, removably mounted in the stand, the panel including a single outlet and a flush valve cover having an inlet aligned with the outlet and in fluid communication with the waste receptacle for receiving waste from the waste receptacle, the inlet in selectable fluid communication with the panel outlet;

a discharge disk including a rotary section and an outlet covering section, the covering section spaced apart from the rotary section, the disk being aperture-free except at the rotary section, the covering section being of a size and shape corresponding to a size and shape of the outlet, the rotary section being mounted to the panel for rotary movement about the rotary section between a closed position in which the covering section seals the outlet from fluid communication with the inlet and an open position in which the discharge disk is clear of the outlet;

gearing mounted on the panel for rotating the flush valve discharge disk in response to a driving force applied to the gearing; and a vacuum generator in fluid communication with the panel outlet.

13. The system of claim 12, wherein the discharge disk is of a shape selected from the group consisting of tear, round and paddle.

14. The system of claim 12, wherein the vacuum generator is a single stage centrifugal vacuum generator.

15. The system of claim 12, wherein at least a portion of the panel has an open lattice structure.

16. The system of claim 12, wherein the vacuum generator includes a housing enclosing an impeller constructed from an engineered polymer.

17. The system of claim 16, wherein the impeller rotates at about 40,000 to 50,000 rpm.

18. The system of claim 12, in which the stand includes one of dovetails and dovetail receivers and the flush valve panel includes one of corresponding dovetail receivers and dovetails, wherein the flush valve panel is attached to the stand by interlocking the dovetails and dovetail receivers.

19. A method for flushing a vacuum toilet system comprising:

providing a vacuum source in fluid communication with an outlet of a valve housing, the valve housing being formed in a panel, the panel serving as a side of a waste receptacle stand, removably mounted in the stand the valve housing having an inlet aligned with the outlet and in selectable fluid communication with the outlet on one side and in fluid communication with a vacuum toilet waste receptacle on an opposite side;

positioning a discharge disk within the valve housing in a closed position over the outlet, the discharge disk including a rotary section and a continuous outlet covering section spaced from the rotary section, the disk being aperture-free except at the rotary section, the covering section being of a size and shape corresponding to the size and shape of the outlet, the positioning being such that a sleeve seal abutting the perimeter of the outlet and disposed in the housing between the outlet and the covering section of the discharge disk seals the outlet; and rotating the rotary section of the discharge disk in a first direction from a closed position in which the covering section seals the outlet from fluid communication with the inlet to an open position in which the discharge disk is substantially clear of the outlet.

20. The system of claim 12, further comprising a sleeve seal disposed in the panel between the outlet and the discharge disk, the sleeve seal abutting a perimeter of the outlet to seal the outlet when the discharge disk is in the closed position.

* * * * *